United States Patent [19]

Moberg et al.

[11] Patent Number: 4,460,203

[45] Date of Patent: Jul. 17, 1984

[54] SEAL OF THE PADLOCK TYPE

[75] Inventors: Sigurd M. Moberg, Etlan, Va.; Allan W. Swift, Denville, N.J.

[73] Assignee: E. J. Brooks Company, Newark, N.J.

[21] Appl. No.: 303,896

[22] Filed: Sep. 21, 1981

[51] Int. Cl.[3] ..... B65D 33/34

[52] U.S. Cl. ..... 292/318

[58] Field of Search ..... 292/317–322

[56] References Cited

U.S. PATENT DOCUMENTS

| | | | |
|---|---|---|---|
| 948,853 | 2/1910 | Gilroy | 70/20 |
| 1,964,897 | 7/1934 | Wenk | 292/320 |
| 1,987,351 | 1/1935 | Rose | 292/318 X |
| 2,140,320 | 12/1938 | Keidel | 292/318 |
| 2,356,856 | 8/1944 | Komenak | 292/318 |

*Primary Examiner*—Richard E. Moore

*Attorney, Agent, or Firm*—Robert E. Ross

[57] ABSTRACT

A seal of the padlock type comprising a plastic body having a pair of spaced apertures for receiving straight ends of a wire shackle. A metal fastener is assembled in the housing, said fastener having flexible tongues for so engaging the shackle ends that they can be easily pushed into the housing but cannot thereafter be retracted. In one embodiment of the invention the tongues have substantially different lengths, so that they engage the wire at longitudinally spaced positions which increases the holding power of the fastener. Means is provided for retaining the shackle in a closed position prior to use to prevent tangling of the seals with each other during shipment and handling.

5 Claims, 8 Drawing Figures

SEAL OF THE PADLOCK TYPE

BACKGROUND OF THE INVENTION

Seals of the padlock type are widely used in the electrical utility industry to seal electric meters and in many other application. Such seals in common use comprise a plastic body having a pair of spaced apertures, and a straight wire shackle having reverse bend ends that are non-removably inserted into the apertures. Such seals are disclosed in U.S. Pat. No. 3,485,521 and 4,278,281.

However there are many applications in which seals of this type cannot be used, in some cases because of the thickness of the wire shackle, and in other cases, because the dimensions and configuration of the device to be sealed do not allow the bent end of the shackle to be inserted through the apertures in the device to be sealed.

SUMMARY OF THE INVENTION

This invention provides a seal of the padlock type comprising a plastic body having a pair of spaced apertures for receiving straight ends of a wire shackle. A metal fastener is assembled in the housing, said fastener having flexible tongues for so engaging the shackle ends that they can be easily pushed into the housing but cannot thereafter be retracted. In one modification of the invention, the fastener has 2 flexible tongues with opposing ends for gripping the wire therebetween. One of the tongues may be substantially longer than the other, so that they grip the wire at longitudinally spaced positions. The engagement of the tongues with the wire shackle thereby may impart a slight bend to the wire, or dig into the wire surface, thereby increasing the holding power of the fastener. Means is provided for retaining the shackle in a closed position prior to use to prevent tangling of the seals with each other during shipment and handling.

In one modification of the invention the plastic housing has a transverse aperture intersecting the shackle receiving apertures for receiving a metal fastener having a pair of spaced shackle engaging portions. In another modification of the invention, the plastic body is formed of two pieces, which are assembled with a metal fastener disposed therebetween for receiving and engaging the ends of the shackle.

Means is provided for retaining the shackle, prior to assembly onto an article to be sealed, in a closed configuration to prevent tangling of the seals with each other during shipment.

DESCRIPTION OF THE ILLUSTRATED EMBODIMENTS

Figure 1:
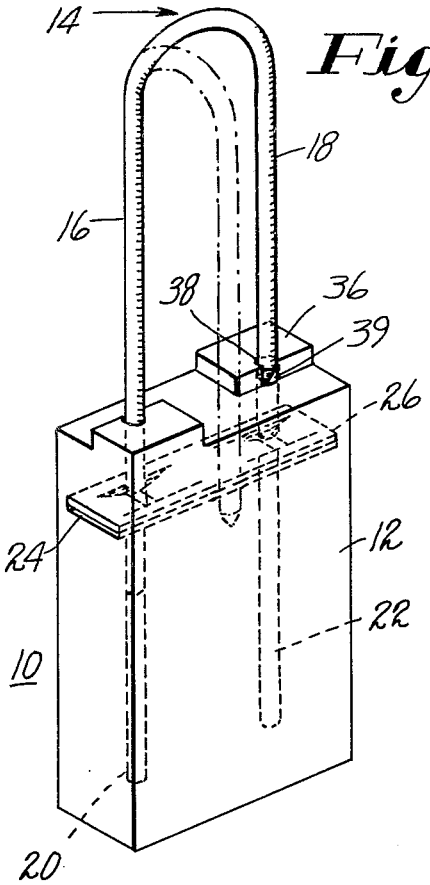
FIG. 1 is a perspective view of a seal embodying the features of the invention.
Figure 4:
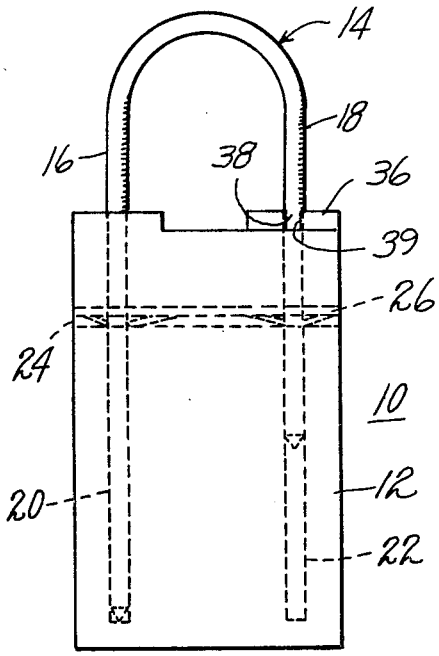
FIG.4 is a front plan view of the seal of FIG. 1 in the sealed condition.
Figure 2:
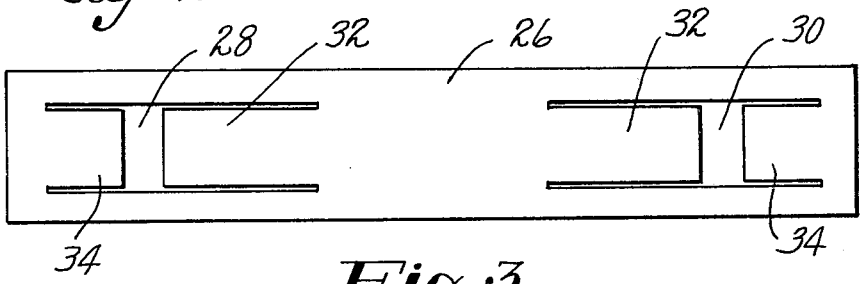
FIG. 2 is an enlarged top plan view of the metal fastener portion of the seal.
Figure 3:
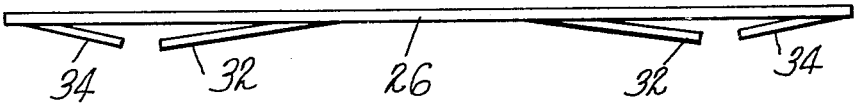
FIG. 3 is a view in side elevation of the fastener of FIG. 2.
Figure 5:
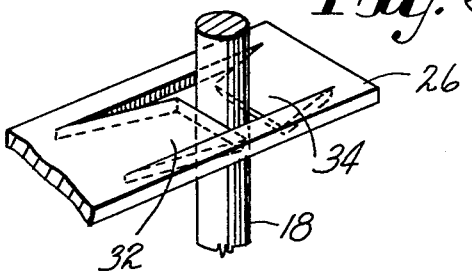
FIG. 5 is an enlarged view of a shackle of the seal in engagement with the fastener of FIGS. 2 and 3.

Referring to FIGS. 1 and 4 of the drawing, there is illustrated a seal 10 of the padlock type, which comprises a plastic body 12 and a wire shackle 14 having long and short straight legs 16 and 18 respectively.

In the embodiment of FIGS. 1 and 4 the body 12 has a pair of spaced apertures 20 and 22 to receive the shackle legs 16 and 18, and a transverse opening 24 extending from a side edge of the body 12 and intersecting the apertures 20 and 22. Assembled into the transverse aperture 24 is a fastener 26, which is preferably formed of spring steel, and has two shackle receving apertures 28 and 30, each formed by opposing long and short spring tongues 32 and 34.

Figure 6:
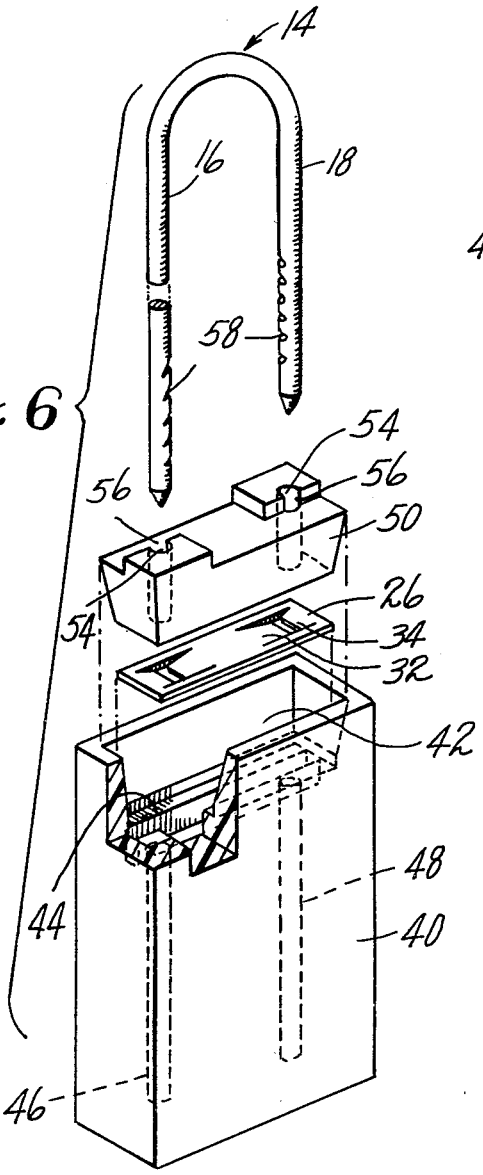
FIG. 6 is an exploded view of a modified form of seal embodying the features of the invention.

During manufacture of the seal, of FIGS. 1 and 4 the fastener 26 is inserted into the transverse opening 24, and the shackel 14 is then inserted into aperture 20 until it passes through the opening 28 in the fastener. The tongues 32 and 34 are initially inclined downwardly to facilitate such insertion and the dimensions of the components are such that the diameter of the shackle leg is greater than the opening between the tongues. Hence entry of the shackle leg between the tongues causes them to flex downwardly to increase the size of the opening therebetween as illustrated in FIG. 6. Thereafter a pulling force applied to the shackle leg causes the tongues to tend to close to cause the ends to bite into the shackle leg to prevent withdrawal thereof. On initial assembly the shackle is inserted into the seal body only until the end of the shorter shackle leg 18 is at the top surface of the seal body. It has been found desirable to maintain the end of the shackle leg 18 positioned directly above and closely adjacent the top of the seal body, to prevent tangling of the seals with each other during handling and shipment.

For this purpose an abutment 36 is provided on the top of the seal body, said abutment having a recess 38 with a restricted entrance 39 so that the shackle may, during assembly, be pushed into the seal body until the end of leg 18 enters the recess 38. Thereafter the leg 18 is retained in the entrance by the restricted entrance during handling and shipment, yet may be prepared for use in forcing the end of the leg 18 out of the recess by rotating the shackle about the leg 16. Thereafter the leg 18 may be inserted through the device to be sealed, rotated back into the recess 38, and pushed down into the seal body into engagement in the aperture 30 of the fastener. Thereafter the shackle cannot be removed without destroying the seal. In a preferred embodiment of the invention, the fastener is formed of spring steel and the shackle is formed of aluminum or other suitable material, so that if too great a pulling force is applied to the assembled shackle, the tongues of the fastener will bite into the shackle and weaken it sufficiently to cause it to break, thus giving evidence of tampering.

Figure 7:
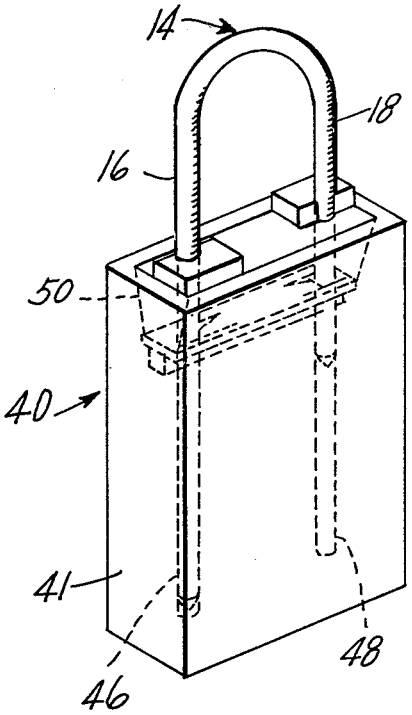
FIG. 7 is a view of the seal of FIG. 6 in the sealed condition.

Referring to FIGS. 6 and 7, there is illustrated a modified form of seal which utilizes the shackle 14 and the fastener 26, however in this modification the seal body 40 comprises a lower portion 41 which has a cavity 42 in the upper end which forms a peripheral ledge 44, and a pair of openings 46 and 48 extending down into the body from the bottom of the cavity. The cavity 42 and the ledge 44 are dimensioned to receive the fastener 26, and the apertures 46 and 48 are positioned to be aligned with the fastener opening. An upper body portion 50 is provided to fit into the cavity, with apertures 52 and 54 positioned to be aligned with the apertures 46 and 48. The upper portion 50 may be retained in the lower portion in any convenient manner, such as by an adhesive or by heat sealing. A shackle 14 may be assembled with the seal body of FIGS. 6 and 7 in the same manner as illustrated in FIGS. 1 and 4, and an abutment 52 with a recess 54 having a restricted opening 56 may be provided for the same purpose as described herein before in connection with the seal of FIGS. 1 and 4. Since the seal is to be assembled by automatic machinery, the seal of the embodiment of FIGS. 1 and 4 must be oriented in such machines so that the top of the seal body faces in a desired direction. However, to avoid further orientation, the transverse opening 24 may extend completely through the seal body so that the fastener 26 may be inserted into either side of the seal, and an abutment similar to abutment 36, with a recess having a restricted opening, may be provided on the corner of the top of the seal opposite the abutment 36. Hence the seal is symmetrical about the vertical axis, so that orientation of the seal body about the vertical axis to accomodate the automatic machinery is not required.

Figure 8:
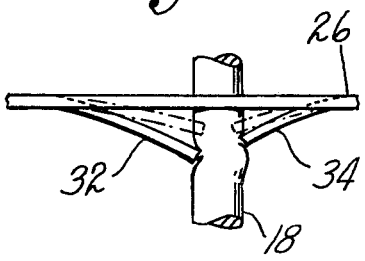
FIG. 8 is an enlarged view of a portion of FIG. 7, illustrating the engagement of the fastener with the wire shackle.

In either embodiment of the invention, the fact that the tongue 32 is longer than the tongue 34 causes the tongues to engage the wire shackle at two longitudinally spaced positions. As illustrated in FIG. 8, it is seen that the engaging force of the longer leg causes the shackle to be bent or burred at the shorter leg, thus increasing the holding power of the fastener.

In either embodiment of the invention, the legs 16 and 18 of the shackle may be provided with notches 58 to facilitate engagement with the fastener 26. Since certain other changes obvious to one skilled in the art may be made in the invention without departing from the scope thereof, it is intended that all matter contained herein be interpreted in an illustrative and not a limiting sense.

I claim:

1. A seal of the padlock type comprising a seal body having a pair of spaced openings to receive legs of a shackle, and a fastener in said body having apertures aligned with a body opening, said fastener apertures being formed by a pair of spring tongues so dimensioned that an inserted shackle leg is gripped between the ends thereof to prevent retraction, one of said ahackle legs being longer that the other and being engaged in one of said fastener apertures and being rotatable therein, the other shackle leg being shorter with the end thereof terminating at the top of the body and being positionable into alignment with the other fastener aperture by rotation of the shackle about the axis of the longer shackle leg, the end of said other leg being removably retained at the top of the seal body in alignment with the other seal aperture.

2. A seal of the padlock type, comprising a seal body having a pair of spaced apertures, a fastener disposed in said body having means aligned with said apertures to engage inserted shackle legs and prevent retraction thereof, a shackle assembled with said body, said shackle having a long leg and a short leg, the long leg being assembled into a body aperture into engagement with the fastener, the end of the other leg being positioned at the top of the seal body and means on the top of the body releasably retaining said end from swinging away from the top of said body.

3. A seal body for a seal of the padlock type for receiving and engaging straight legs of a U-shaped shackle, comprising a lower body portion and an upper body portion secured thereto, a fastener retained between said portions, said fastener having a pair of spaced openings disposed between the ends of resilient tongues to receive a shackle leg in gripping engagement, and a pair of openings in the upper portion and the lower portion, said openings being aligned with the fastener openings, the upper surface of the upper portion of the seal having means for releasably retaining against lateral movement the end of a shackle leg.

4. A seal body as set out in claim 3 in which said means on the upper surface of the seal retains the end of the shackle leg in alignment with one of said pair of openings.

5. A seal body for a seal of the padlock type for receiving and engaging the straight legs of a U-shaped shackle, comprising a lower body portion having a cavity in the upper surface, a fastener having a pair of spaced openings formed by opposing resilient tongues positioned and dimensioned to engage an inserted shackle leg, an upper body portion mounted on the lower body portion, said upper body portion having means on the lower side thereof entering the recess and retaining the fastener in assembly in the body, a pair of spaced apertures in the upper and lower body portions, said apertures being aligned with the openings in the fastener, the upper surface of the body having an abutment and a recess with a restricted opening to the side thereof, said recess being aligned with an aperture in the body, said restricted opening to the recess releasably retaining the end of a shackle leg.

* * * * *